US006880634B2

(12) United States Patent
Gardner et al.

(10) Patent No.: US 6,880,634 B2
(45) Date of Patent: Apr. 19, 2005

(54) COILED TUBING ACOUSTIC TELEMETRY SYSTEM AND METHOD

(75) Inventors: Wallace R. Gardner, Houston, TX (US); Vimal V. Shah, Sugar Land, TX (US); Donald G. Kyle, Plano, TX (US); Hampton Fowler, Jr., Spring, TX (US); Leonard Case, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/308,610

(22) Filed: Dec. 3, 2002

(65) Prior Publication Data

US 2004/0105342 A1 Jun. 3, 2004

(51) Int. Cl.[7] ..... E21B 47/16; E21B 19/22

(52) U.S. Cl. ..... 166/250.01; 166/84.4; 166/77.2; 166/66; 340/856.4; 340/854.4; 367/81

(58) Field of Search ..... 166/250.01, 66, 166/77.2, 387, 84.4, 85.3; 367/81, 82, 25; 340/854.4, 856.4

(56) References Cited

U.S. PATENT DOCUMENTS

| | | | | | |
|---|---|---|---|---|---|
| 5,365,229 | A | | 11/1994 | Gardner et al. | 340/855.4 |
| 5,387,907 | A | | 2/1995 | Gardner et al. | 340/854.9 |
| 5,490,121 | A | | 2/1996 | Gardner et al. | 367/83 |
| 5,509,474 | A | | 4/1996 | Cooke, Jr. | 166/64 |
| 5,515,336 | A | | 5/1996 | Chin et al. | 367/83 |
| 5,519,731 | A | * | 5/1996 | Cioffi | 375/260 |
| 5,566,753 | A | * | 10/1996 | Van Winkle et al. | 166/84.1 |
| 5,583,827 | A | | 12/1996 | Chin | 367/84 |
| 5,597,042 | A | * | 1/1997 | Tubel et al. | 166/250.01 |
| 5,706,896 | A | | 1/1998 | Tubel et al. | 166/313 |
| 5,831,549 | A | * | 11/1998 | Gearhart | 340/853.1 |
| 5,898,517 | A | * | 4/1999 | Weis | 356/5.09 |
| 5,924,499 | A | | 7/1999 | Birchak et al. | 175/40 |
| 5,941,307 | A | | 8/1999 | Tubel | 166/313 |
| 6,009,122 | A | * | 12/1999 | Chow | 375/260 |
| 6,129,160 | A | | 10/2000 | Williams et al. | 175/107 |
| 6,137,747 | A | | 10/2000 | Shah et al. | 367/81 |
| 6,175,316 | B1 | * | 1/2001 | Barsoum et al. | 341/54 |
| 6,192,983 | B1 | | 2/2001 | Neuroth et al. | 166/250.15 |
| 6,272,916 | B1 | * | 8/2001 | Taniguchi et al. | 73/152.47 |
| 6,320,820 | B1 | | 11/2001 | Gardner et al. | 367/81 |
| 6,348,876 | B1 | * | 2/2002 | Wei et al. | 340/854.9 |
| 6,370,082 | B1 | | 4/2002 | Gardner et al. | 367/82 |
| 6,442,105 | B1 | * | 8/2002 | Tubel et al. | 367/82 |
| 6,598,687 | B1 | * | 7/2003 | Eppink et al. | 175/73 |
| 2003/0164240 | A1 | * | 9/2003 | Vinegar et al. | 166/372 |

* cited by examiner

*Primary Examiner*—David Bagnell
*Assistant Examiner*—Shane Bomar
(74) *Attorney, Agent, or Firm*—John W. Wustenberg; E. Harry Gilbert, III

(57) ABSTRACT

System, apparatus, and method of telemetering downhole sensor information to the surface while operations are performed in an oil or gas well using coiled tubing. Data are transmitted on coiled tubing as digital signals encoded in acoustic signals. In one implementation, a stripper packer through which coiled tubing is moved into a well is operated between at least a first state and a second state; and an acoustic communication device responds to operation of the stripper packer such that when the stripper packer is in the first state, the acoustic communication device is decoupled from acoustic communication with the coiled tubing, but when the stripper packer is in the second state, the acoustic communication device is coupled for acoustic communication with the coiled tubing.

22 Claims, 11 Drawing Sheets

COILED TUBING ACOUSTIC TELEMETRY SYSTEM AND METHOD

BACKGROUND OF THE INVENTION

The present invention generally relates to telemetering downhole sensor information while conducting operations in an oil or gas well using coiled tubing. More particularly, it relates to transmission of downhole sensor data during a coiled-tubing hydraulic fracturing operation such that the data can be processed at the surface to assess downhole conditions and further used to optimize the fracturing operation.

An oilfield hydraulic fracturing process involves subjecting a geologic formation to hydraulic pressure, typically using a specialized fracturing fluid that includes particulate material referred to as proppant. The fracturing fluid is typically pumped down a tubing string made either of jointed pipe sections or continuous coiled tubing. The present invention pertains particularly to a coiled tubing conduit as opposed to a string of jointed pipe. The fracturing treatment results in the development of a series of fractures in the formation which enhance extraction of hydrocarbons from the formation.

Such treatment processes have been designed and modified based on measurement of hydraulic pressure at the surface. Numerical models utilize the surface pressure measurements to extrapolate the annular pressure at the fracture zone in designing the proppant volume in the fluid; however, actual downhole memory gauge measurements have indicated that the extrapolated pressures can vastly differ from the measured annular pressures at the fractured zone. Differences in extrapolated measurements from actual annular pressures can result in either longer treatment periods or inefficient treatment. Real-time access to actual annular pressure data could significantly improve and optimize the treatment process.

At present, wireless methods of transmitting downhole sensor data are not commercially available for coiled tubing delivered services. The industry has investigated e-line or e-coiled tubing (that is, electrical transmission along wire or coiled tubing) to access this important data. However, attempts to do so have had problems due to interference of the fracturing fluid flow with the e-line and the harsh nature of the fluid and proppants that have damaged the e-line. Mud pulse telemetry is a known technique, but its rates are slower than the minimum required for the fracturing job pressure data transmission application referred to above, for example. The mud pulse telemetry pulser also wears quickly due to the abrasive proppant flowing through it. In addition, pressure pulses may interfere with critical pressure measurements. Electromagnetic (EM) telemetry has been considered for coiled tubing services, but its data rate is lower than the minimum required for the application. EM signals also encounter high attenuation in regions of low formation resistivity, in cased holes, and where borehole fluid is highly conductive. Regarding acoustic telemetry, Halliburton has developed and commercialized an acoustic telemetry system (ATS) designed to operate on jointed pipe. The acoustic transmission channel characteristics of jointed pipe include frequency banding due to reflections at tool joints. The ATS system employs modified FSK telemetry to overcome the transmission channel characteristics. There is presently no commercial wireless method to transmit sensor data from downhole during coiled tubing delivered services.

It is apparent from the foregoing that there is a need for a wireless telemetry system that is capable of transmitting real-time sensor data to the surface during coiled tubing delivered services. In addition, the telemetry system needs to function in a corrosive and abrasive environment, such as encountered during fracturing a subterranean formation, for example.

SUMMARY OF THE INVENTION

The present invention meets the aforementioned needs by providing system, apparatus, and method for telemetering downhole sensor information while performing operations in an oil or gas well using coiled tubing.

More particularly, the present invention provides a coiled tubing acoustic telemetry method comprising transmitting data on a coiled tubing string as acoustic signals encoding the data such as by using at least one of quadrature amplitude modulation, discrete multi-tone, multiple frequency shift keying, and multiple on-off keying.

Regardless of the encoding technique, whether one of the foregoing or not, the present invention can also be defined as a method of providing for acoustic communication at a wellhead, comprising: operating a stripper packer between respective first and second positions relative to coiled tubing extending through the stripper packer; and concurrently with operating the stripper packer, moving an acoustic communication device between respective first and second positions relative to the coiled tubing. In a particular implementation, moving the acoustic communication device concurrently with operating the stripper packer includes moving the acoustic communication device in response to operating the stripper packer; and more specifically, operating the stripper packer includes using a hydraulic actuator of the stripper packer and moving the acoustic communication device includes operating a hydraulic piston of the acoustic communication device using the hydraulic actuator of the stripper packer. In such particular implementation, the acoustic communication device is unclamped from the coiled tubing in the respective first position of the acoustic communication device relative to the coiled tubing and the acoustic communication device is clamped to the coiled tubing in the respective second position of the acoustic communication device relative to the coiled tubing.

The present invention also provides an acoustic communication device for coiled tubing moved into a well through wellhead equipment. This acoustic communication device comprises an acoustic member and a traveling member connected to the acoustic member. The traveling member, such as implemented as a clamp, is configured to respond to the wellhead equipment that moves the coiled tubing into the well such that the traveling member moves the acoustic member relative to the coiled tubing in response to operation of the wellhead equipment relative to the coiled tubing.

The present invention further provides an acoustic communication device for a coiled tubing system including a stripper packer having a hydraulic actuator. The acoustic communication device comprises an accelerometer mounted to move selectably between contact and non-contact positions relative to coiled tubing moved into a well through the stripper packer, wherein movement of the accelerometer relative to the coiled tubing is responsive to the hydraulic actuator operating the stripper packer.

The present invention still further provides a coiled tubing system using acoustic communication along coiled tubing operatively associated with a wellhead assembly that comprises: a stripper packer through which coiled tubing is moved into a well, the stripper packer operable between at least a first state and a second state; and an acoustic communication device responsive to operation of the stripper packer between the at least first and second states such that when the stripper packer is in the first state, the acoustic communication device is decoupled from acoustic communication with the coiled tubing, but when the stripper packer is in the second state, the acoustic communication device is coupled for acoustic communication with the coiled tubing. The foregoing can be part of a coiled tubing telemetry system also comprising: a downhole assembly having an acoustic transducer configured to generate modulated acoustic signals in a well; and a coiled tubing string configured to transport the acoustic signals to the surface. This system can further comprise a repeater (that is, one or more repeaters) spaced along the coiled tubing string to boost the acoustic signals. In a particular implementation, the stripper packer includes a hydraulic actuator and the acoustic communication device is connected to the hydraulic actuator, such as by a hydraulic piston connected to the hydraulic actuator. In one particular implementation, the acoustic communication device further includes an accelerometer connected to the hydraulic piston. In particular implementations, quadrature amplitude modulation, discrete multi-tone modulation, multi-channel frequency shift keying modulation, and multi-channel on-off keying modulation can be used.

It is a general object of the present invention to provide novel and improved wireless telemetry system, apparatus, and method utilizing acoustic wave transmission through coiled tubing material to convey sensor data to the surface. Other and further objects, features, and advantages of the present invention will be readily apparent to those skilled in the art when the following description of the preferred embodiments is read in conjunction with the accompanying drawings.

BRIEF DESCRIPTION OF THE DRAWINGS

FIG. 6 shows an implementation of a wideband QAM embodiment of a coiled tubing acoustic telemetry system of the present invention.

FIG. 9 is a block diagram similar to a Halliburton ATS FSK receiver.

DETAILED DESCRIPTION OF THE INVENTION

Figure 1:
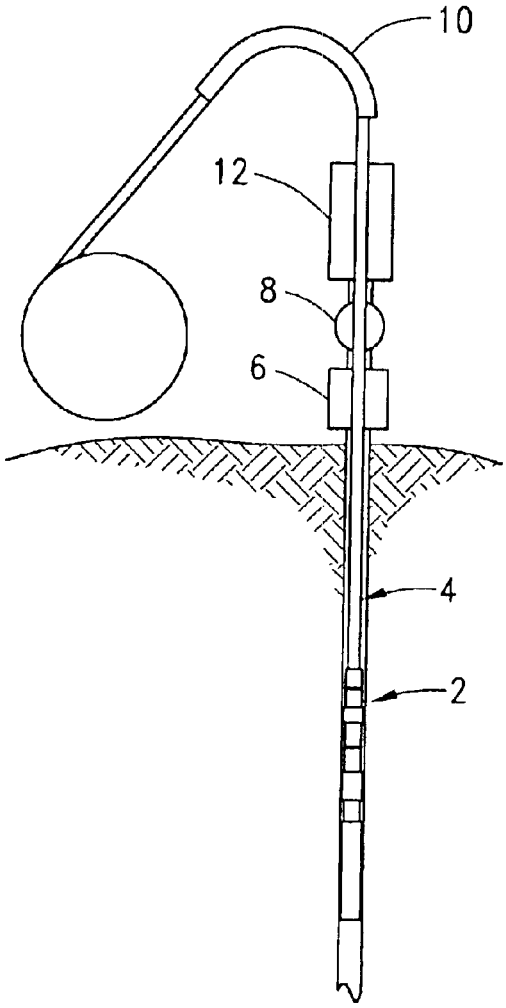
FIG. 1 is a schematic representation of an uplink only mode of a telemetry apparatus and system of the present invention.
Figure 2:
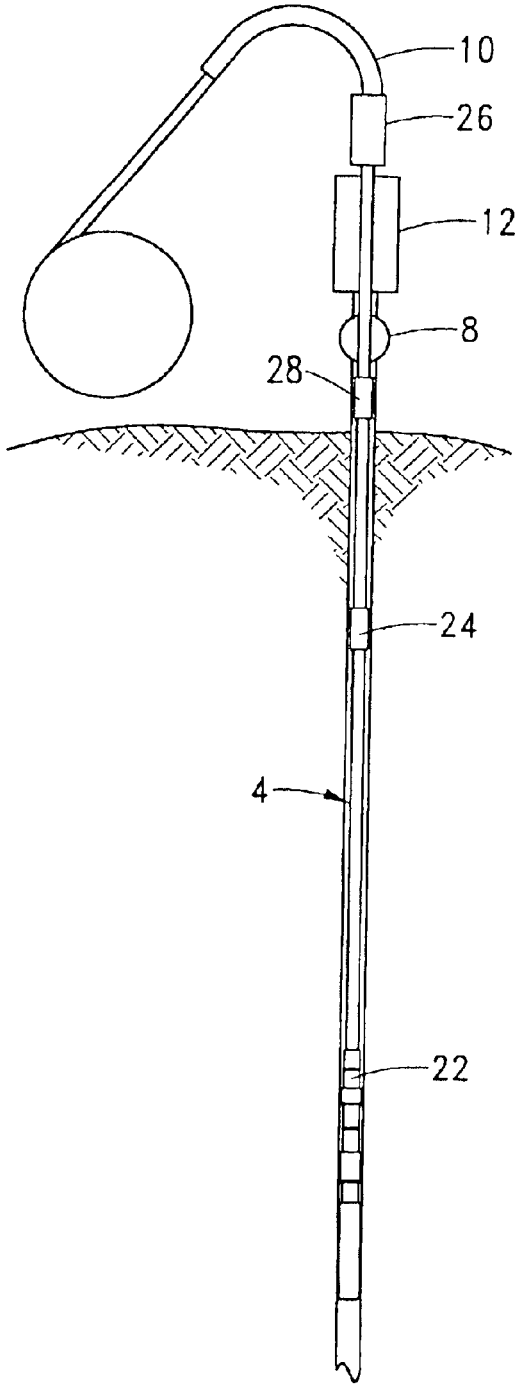
FIG. 2 is a schematic representation of a bidirectional mode of a telemetry apparatus and system of the present invention.

Schematics of a telemetry system in two different configurations for the present invention are shown in FIGS. 1 and 2. An acoustic transceiver 2 forms a part of a bottom hole assembly (BHA). In the uplink only mode (FIG. 1), the acoustic transceiver 2 includes a piezoelectric stack assembly that is rigidly mounted on a through-bore mandrel, an electrical driver, and a digital signal processor (DSP). The DSP collects relevant data (typically, pressure and temperature) from a sensor pack located in the zone of interest, on the BHA, compresses and packages the data stream, and transmits the data to the electrical driver. The electrical driver drives the piezoelectric stack to generate acoustic signals, which travel through material of the coiled tubing 4 to the surface. The acoustic signals at the surface are picked up by a receiver 6, comprising an acoustic pickup, also known as an acoustic member or accelerometer, on the coiled tubing 4 and associated circuitry to amplify, filter, and decode the acoustic signals.

In FIG. 1 the acoustic pickup of the receiver 6 is illustrated as next to a conventional stripper packer 8 through which the coiled tubing 4 is moved into the well in known manner. In general, the stripper packer 8 is operable between at least a first state (such as when the stripper packer 8 is disengaged from the coiled tubing 4) and a second state (such as when the stripper packer 8 engages the coiled tubing 4). The receiver can in general be placed where engagement with the coiled tubing 4 can occur. Another example of such a location is between a conventional gooseneck 10 and a conventional injector 12 of the coiled tubing system. So, the present invention provides an acoustic communication device for coiled tubing 4 moved into a well through wellhead equipment.

In a preferred embodiment, the acoustic pickup is mounted on a traveling member embodied in this example by a hydraulic powered clamp that can be actuated to clamp the acoustic pickup with the coiled tubing 4 (more than one pickup or accelerometer may be used, but only one is referred to in the drawings for simplicity). The clamp is configured to respond to the wellhead equipment that moves the coiled tubing 4 into the well such that, via operation of the clamp, the acoustic pickup is selectably moved between contact and non-contact positions relative to the coiled tubing 4 in response to operation of the wellhead equipment relative to the coiled tubing 4. In the FIG. 1 illustration, for example, the stripper packer 8 is hydraulically actuated when a desired zone of treatment is reached and the coiled tubing 4 stops tripping into the well. The acoustic pickup could be damaged if clamped while the coiled tubing 4 is tripping in the hole; therefore, positioning of the acoustic pickup can be actuated by the same hydraulic lines that actuate the stripper packer 8 to ensure that the acoustic pickup is decoupled from the coiled tubing 4 until the coiled tubing 4 has stopped moving. In a particular implementation, the clamp hydraulics tap into the stripper packer hydraulic line, and the hydraulics of the clamp are designed to engage with or after the stripper packer 8 completely engages and to disengage with or before the stripper packer 8 disengages to preclude contacting engagement when the coiled tubing 4 is being moved. The clamp is capable of providing an adequate coupling or clamping force for the accelerometer to maximize signal pickup from the adjacent coiled tubing material.

Figure 3:
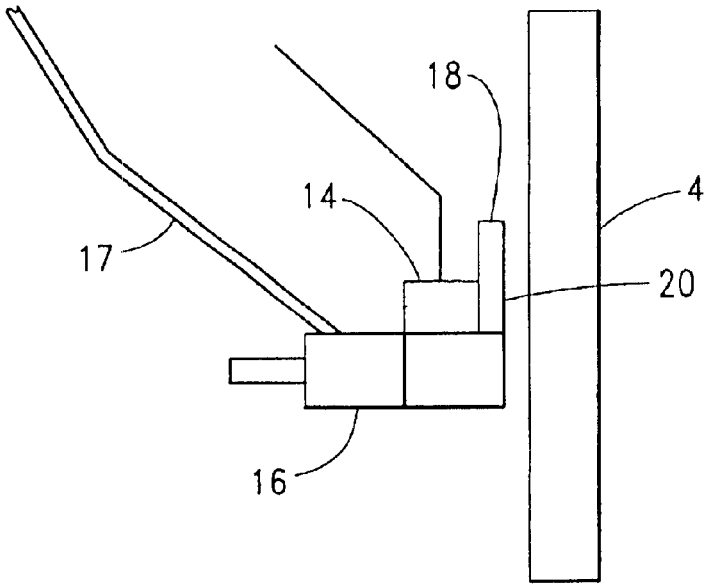
FIG. 3 schematically represents an acoustic communication device of the present invention in a disengaged position.
Figure 4:
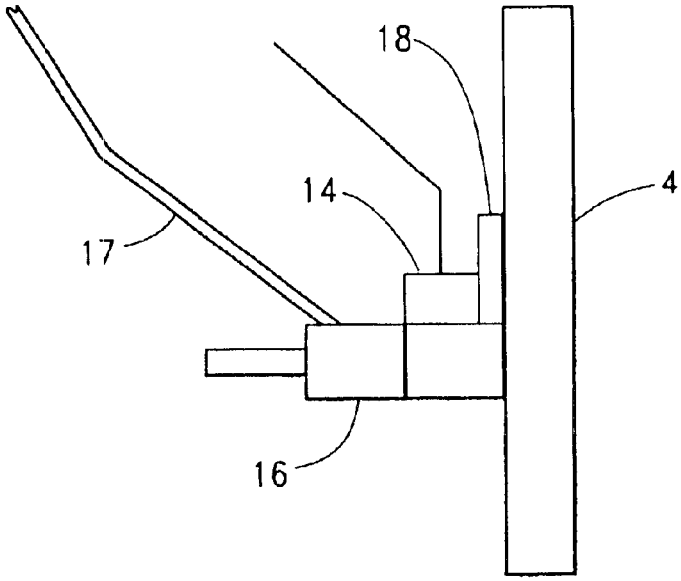
FIG. 4 schematically represents the acoustic communication device of FIG. 3 in an engaged position.

In the embodiment of FIGS. 3 and 4, the acoustic communication device includes an accelerometer 14; however, it will be evident to those in the art that the accelerometer 14 can be replaced with other suitable equipment, one example of which is a piezoelectric stack and associated circuitry that are capable of receiving and transmitting acoustic signals, when adequate space on the clamp is available.

In the illustrated embodiment of FIGS. 3 and 4, the traveling member clamp comprises a hydraulic piston 16 connected through hose 17 in hydraulic communication with the hydraulic actuator of the stripper packer 8. The accelerometer 14 of this embodiment is connected to the hydraulic piston 16. Such connection is by way of a mounting block 18 connected to the accelerometer 14 and the hydraulic piston 16 for the embodiment of FIGS. 3 and 4. The mounting block 18 includes a surface 20, disposed between the accelerometer 14 and the coiled tubing 4, to contact the coiled tubing 4 when the accelerometer 14 is in the contact position as illustrated in FIG. 4. Suitable support structure, such as including a housing, is also provided in any suitable manner readily known to one skilled in the art.

In accordance with a method of the present invention as described with reference to but not limited by FIG. 1, the stripper packer 8 is operated in known manner between respective first and second positions relative to the coiled tubing 4 extending through the stripper packer 8. Concurrently with operating the stripper packer 8, the acoustic communication device is moved between respective first and second positions relative to the coiled tubing 4 such as represented in FIGS. 3 and 4, for example. Moving the acoustic communication device concurrently with operating the stripper packer 8 includes moving the acoustic communication device in response to operating the stripper packer 8 in the example of FIGS. 1, 3, and 4. Operating the stripper packer 8 in such example includes using the hydraulic actuator of the stripper packer 8 in known manner; and moving the acoustic communication device of this example includes operating the hydraulic piston 16 using the hydraulic actuator of the stripper packer 8 (including its operating pressure as communicated through the hose 17). The acoustic communication device is unclamped from the coiled tubing 4 in the respective first position of the acoustic communication device relative to the coiled tubing 4, and the acoustic communication device is clamped to the coiled tubing 4 in the respective second position of the acoustic communication device relative to the coiled tubing 4.

FIG. 2 illustrates a bi-directional telemetry system of the present invention, comprising a downhole transceiver 22, a strappable repeater 24 which acts as a signal amplifier for deep well applications, and a surface downlink transceiver 26. The downhole transceiver 22, in addition to generating acoustic signals corresponding to sensor data, can also receive command signals from the surface, decode and interpret the signals, and respond according to the commands. The reception and decoding can be performed, for example, using the aforementioned piezoelectric stack as a signal receiver and using the DSP to decode, interpret, and respond to the command. Alternatively, an additional accelerometer can be used to receive the acoustic signal and the DSP can process the acoustic signal further. There are alternative locations for the surface downlink transceiver 26. It can be located, for example, either as depicted in FIG. 1 for the receiver 6, or as depicted in FIG. 2 close to the gooseneck 10 if the channel attenuation is not excessive or with conductors or short hop telemetry 28 to the surface downlink transceiver 26 in case attenuation through the stripper packer 8 is excessive.

In a preferred embodiment, the strappable repeater 24 includes a transmitter, receiver, electronics, battery pack, and clamps. The clamps enable the strappable repeater 24 to be automatically assembled on the coiled tubing 4 while tripping the well. The clamps also enable the strappable repeater 24 to be automatically disassembled and retrieved when tripping out of the hole after completion of the job. One or more strappable repeaters 24 spaced along the coiled tubing 4 can be used to boost the acoustic signal.

The present invention makes use of the wide frequency band that coiled tubing provides. Traditional acoustic telemetry systems on jointed tubing are required to send signals in the narrow pass bands that jointed tubing provides. We have, however, discovered that coiled tubing is acoustically jointless for long distances despite welds (for example, helical welds) on the coiled tubing and that it has a bandwidth of at least about two kilohertz. Therefore, the pass band of coiled tubing is relatively very wide and therefore allows higher telemetry rates. Because of this available bandwidth, broad band signaling techniques can be applied to downhole wireless communication on coiled tubing, and we have discovered that such broad band techniques are not overcome with channel distortion and thereby provide additional data communication bandwidth as compared with prior frequency shift keying (FSK) and on-off keying (OOK) techniques.

Accordingly, the present invention also provides:

(1) A coiled tubing acoustic telemetry method comprising transmitting data on a coiled tubing string as acoustic signals encoding the data using quadrature amplitude modulation (QAM).

(2) A coiled tubing acoustic telemetry method comprising transmitting data on a coiled tubing string as acoustic signals encoding the data using discrete multi-tone (DMT).

(3) A coiled tubing acoustic telemetry method comprising transmitting data on a coiled tubing string as acoustic signals encoding the data using multiple frequency shift keying (FSK) channels.

(4) A coiled tubing acoustic telemetry method comprising transmitting data on a coiled tubing string as acoustic signals encoding the data using multiple on-off keying (OOK) channels.

(5) A coiled tubing acoustic telemetry method comprising transmitting data on a coiled tubing string as acoustic signals encoding the data only from the group consisting of quadrature amplitude modulation, discrete multi-tone, multi-channel frequency shift keying, and multi-channel on-off keying. These methods of telemetering data that take advantage of the broadband channel of coiled tubing are disclosed in more detail below.

A detailed description of these and other digital modulation techniques may be found in chapter 4 of J. Proakis, *Digital Communications,* McGraw Hill ($2^{nd}$ ed 1989) or in other references cited herein.

Figure 5A:
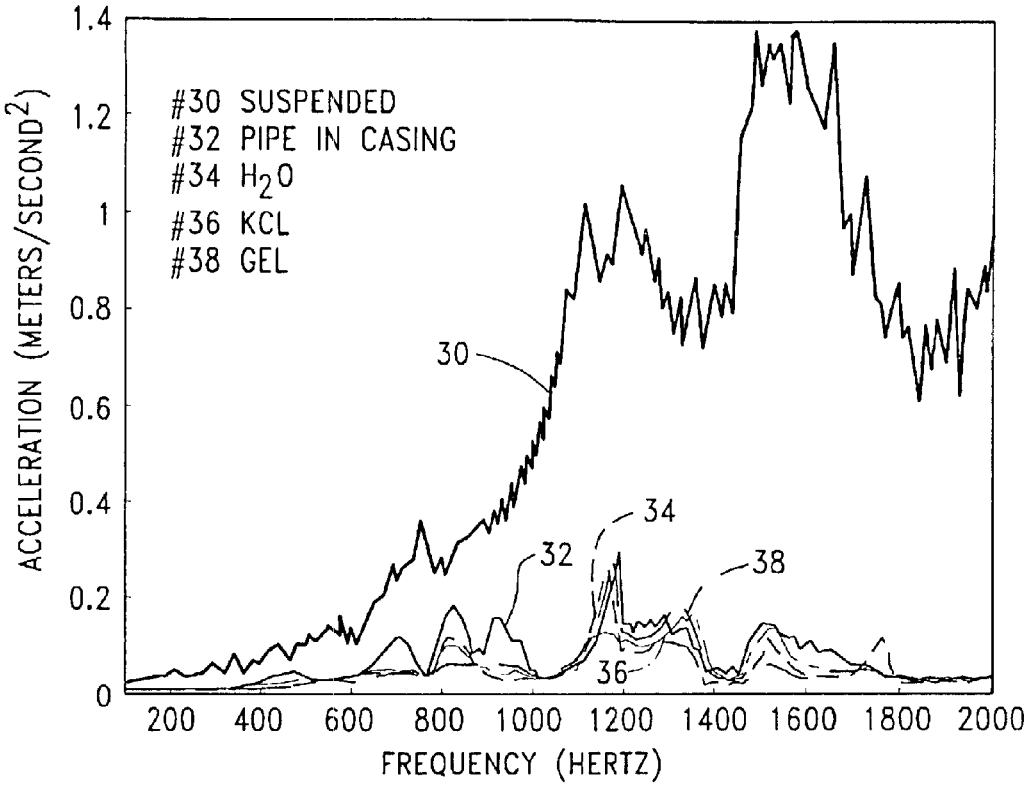
FIG. 5A shows swept frequency responses of acoustic signals through 1000 feet of 2⅜-inch coiled tubing.

Wideband QAM, which cannot be implemented in the present ATS on jointed pipe due at least to multiple signal reflections at pipe joints, is feasible for use with coiled tubing. FIG. 5A shows swept frequency responses of acoustic signals through 1000 feet of 2⅜-inch coiled tubing. The coiled tubing was first tested empty and suspended above ground, then under various conditions inside 7-inch casing. These conditions included various fluids pumped through the coiled tubing and circulated back out from the casing. To simplify the testing procedure, the fluids did not contain proppants. The channel response was tested for a frequency range of 100 hertz (Hz) to 2000 Hz.

Figure 5B:
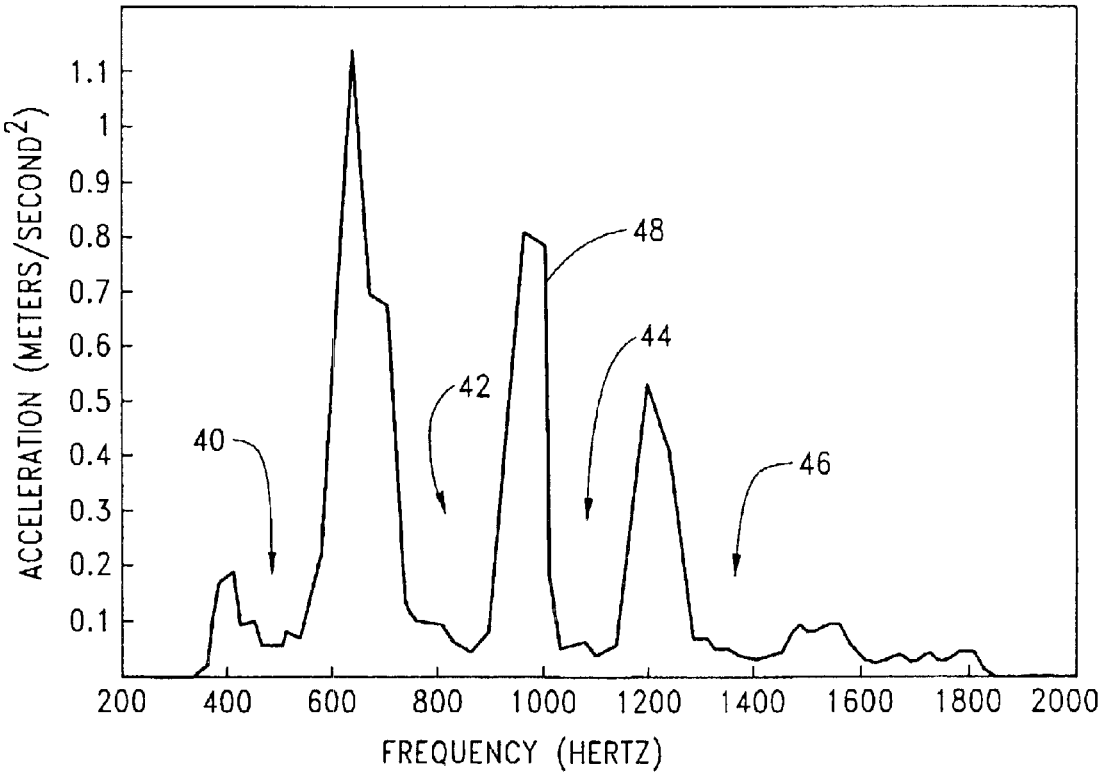
FIG. 5B shows a swept frequency response of an acoustic signal through 1000 feet of 3½-inch jointed drill pipe.
Figure 5:
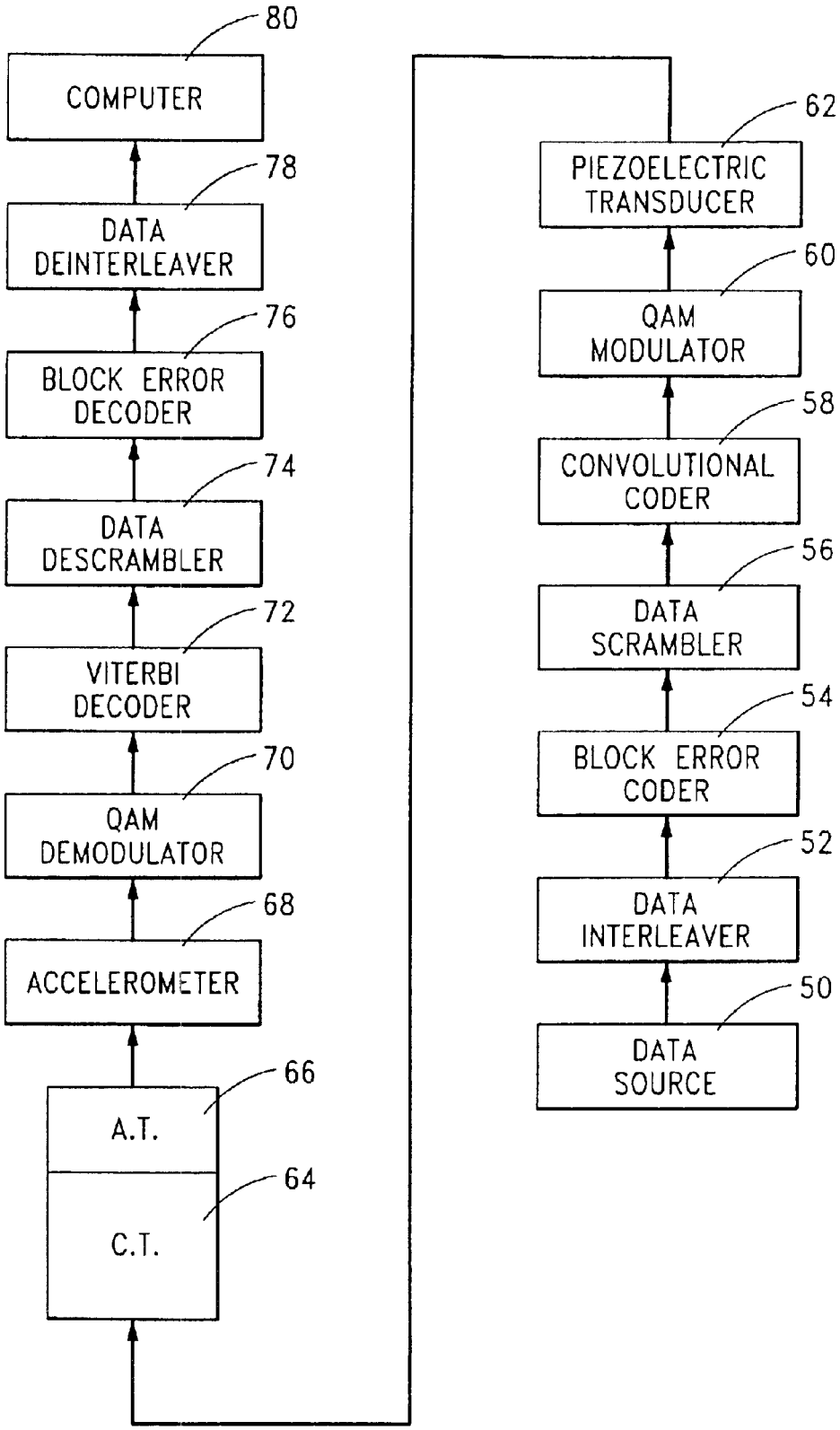

Referring to FIG. 5A, "suspended" curve 30 represents the signal measured at the receiver when the coiled tubing was empty and laid on supports to suspend it above the ground. Curve 30 approximates the intrinsic response of the particular coiled tubing to the particular source and receiver with minimal externalities. "Pipe in casing" curve 32 represents the signal measured at the receiver when the coiled tubing was empty but pushed inside casing, with the stripper packer activated at one end. "$H_2O$" curve 34 represents the signal measured at the receiver when the coiled tubing was inside the casing and filled with water, with the stripper packed activated at one end. "KCl" curve 36 represents the signal measured at the receiver when the coiled tubing was inside the casing and filled with a solution of water and 2% dissolved potassium chloride, with the stripper packer activated at one end. "Gel" curve 38 represents the signal measured at the receiver when the coiled tubing was inside the casing and filled with a solution of water, 2% dissolved potassium chloride and a viscosifier, with the stripper packer activated at one end. Similarities among the curves 34, 36, 38 show that the response of the coiled tubing to acoustic signals is not a strong function of the fluids enclosed inside and on the outside of the tubing. The coiled tubing frequency response also does not contain sharp frequency notches, and thus is seen to be fairly wideband, lacking the strong banding seen in the frequency response of jointed tubing illustrated in FIG. 5B (compare, for example, the frequency response magnitudes above about 0.2 meters/second$^2$ in FIGS. 5A and 5B, in which there are response gaps 40, 42, 44, 46 in curve 48 of FIG. 5B but none in the corresponding range of FIG. 5A for the comparable curve 30). Note that the drill pipe response in FIG. 5B is for jointed pipe that was empty and laid on supports to suspend it above ground as was done with the coiled tubing in obtaining the curve 30. These do not include attenuation due to passage through a stripper packer as occurs in the other signals of FIG. 5A; however, this attenuation decrease in the response signal amplitude in the coiled tubing does not affect the conclusion or existence of a wider bandwidth in coiled tubing over a jointed tubing or pipe string. This wideband characteristic of the coiled tubing proportionally affects the data bandwidth, which makes it a communication channel suitable,for the transmission of wideband QAM signals or other wideband signal transmission techniques, such as the following.

Another preferred approach is to use DMT similar to the system used in commercial asymmetric digital subscriber line (ADSL) telephony. Even though the bandwidth for ADSL on twisted pair cable in a telephone network is greater than the bandwidth of the coiled tubing acoustic transmission channel, DMT works on coiled tubing by scaling down all the frequencies involved.

Other implementations of the present invention use FSK or OOK telemetry similar to the present ATS system. Because of the wideband nature of the coiled tubing transmission channel, however, multiple FSK or OOK channels (also referred to herein as multi-channel FSK or OOK) can be used at the same time, increasing the data rate and system reliability compared to the present ATS system for jointed tubing or pipe strings.

FIG. 6 shows an implementation of a wideband QAM embodiment of a coiled tubing acoustic telemetry system of the present invention. The acoustic transmitter is fed by a data source 50, such as a known downhole pressure sensor, for example. The acoustic transmitter includes a data interleaver 52, a block error coder 54, a data scrambler 56, a convolutional coder 58, and a QAM modulator 60. The QAM modulated signal feeds a piezoelectric transducer 62, which outputs an acoustic signal or wave into one end of the coiled tubing acoustic transmission medium 64. At the far end of the coiled tubing acoustic transmission medium 64, there is an acoustic terminator 66 (such as provided, for example, by the stripper packer 8 that acts as an attenuator to dampen the acoustic signal so that it does not reflect back into the coiled tubing). An accelerometer transducer 68 connected to the far end of the coiled tubing acoustic transmission medium 64 converts the acoustic signal in the coiled tubing acoustic transmission medium 64 into an electrical signal. The electrical signal from the accelerometer transducer 68 feeds the telemetry receiver. The telemetry receiver includes a QAM demodulator 70, a Viterbi decoder 72, a data descrambler 74, a block error decoder 76, and a data deinterleaver 78. The output of the telemetry receiver goes to a computer 80, which can be any suitably programmed computer (for example, programmed microcontrollers or personal computers for use at oil or gas well sites). The foregoing communication devices are well known in the digital communications field. The QAM modulator 60 and demodulator 70 are required blocks in the QAM system. The data interleaver 52/deinterleaver 78, block error coder 54/decoder 76, data scrambler 56/descrambler 74 and convolutional coder 58/Viterbi decoder 72 are "pairs" that work together but are not absolutely necessary for a QAM system.

Figure 7:
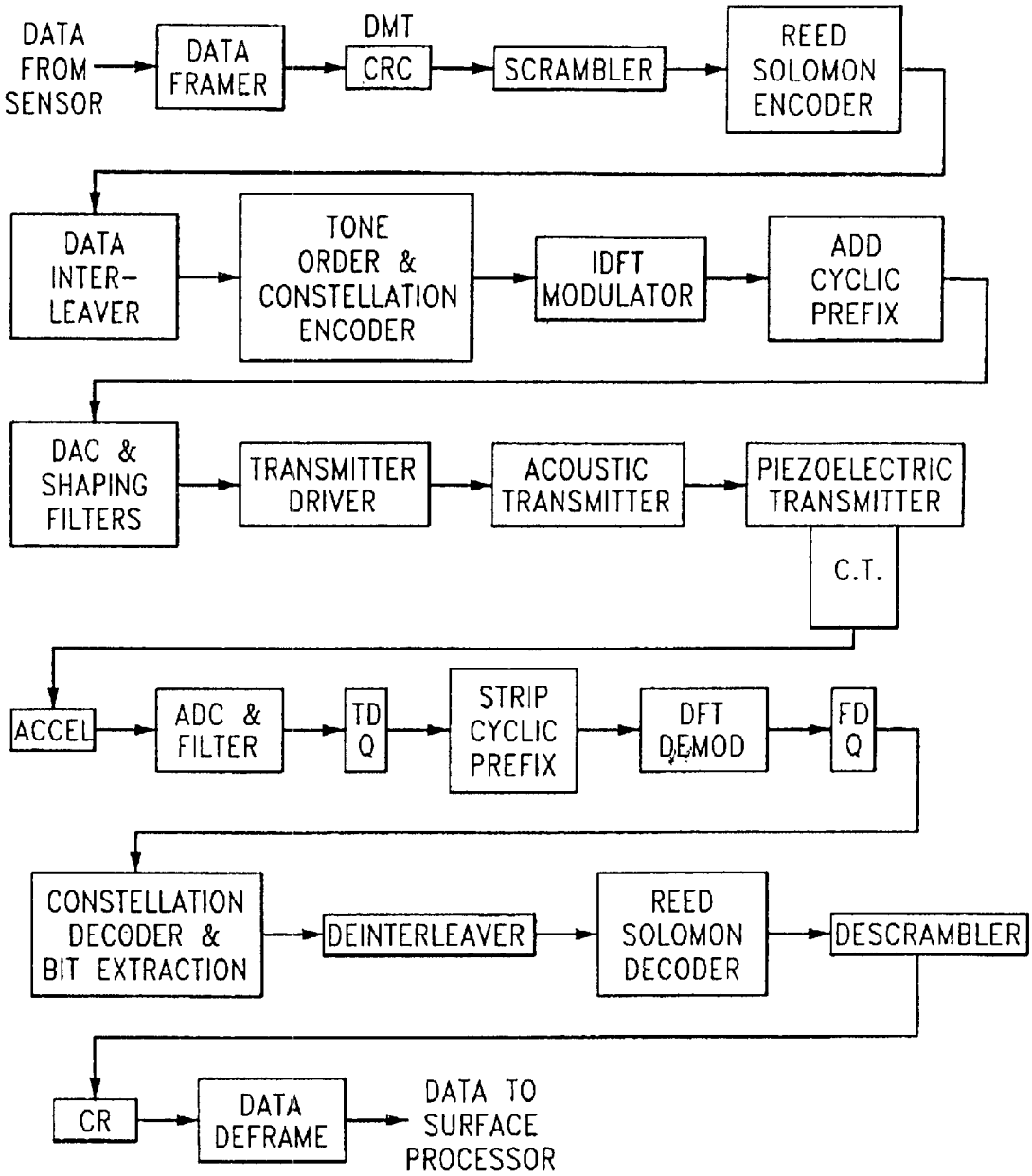
FIG. 7 shows an implementation of a discrete multi-tone (DMT) embodiment of a coiled tubing acoustic telemetry system of the present invention.

FIG. 7 shows an implementation of a DMT embodiment of a coiled tubing acoustic telemetry system of the present invention. DMT in general is a known transmission technique, see, D. Rauschmayer, *ADSL/VDSL Principle: A Practical and Precise Study of Asymmetric Digital Subscriber Lines and Very High Speed Digital Subscriber Lines,* Macmillan Technical Publishing (1999), in which the various DMT blocks of FIG. 7 are known.

Figure 8:
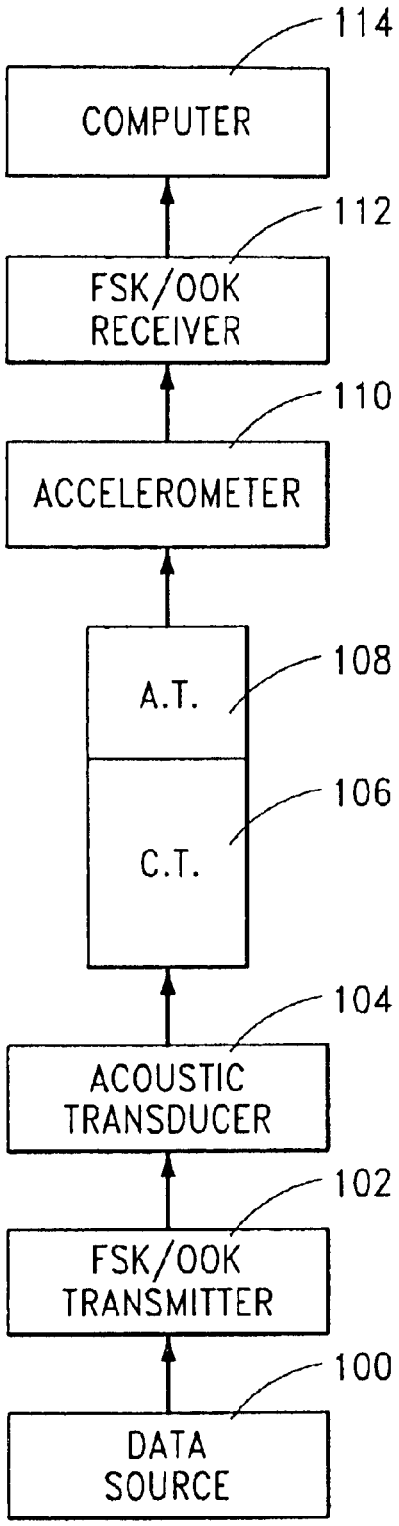
FIG. 8 is a block diagram of a FSK/OOK telemetry system in accordance with the present invention.
Figure 3:
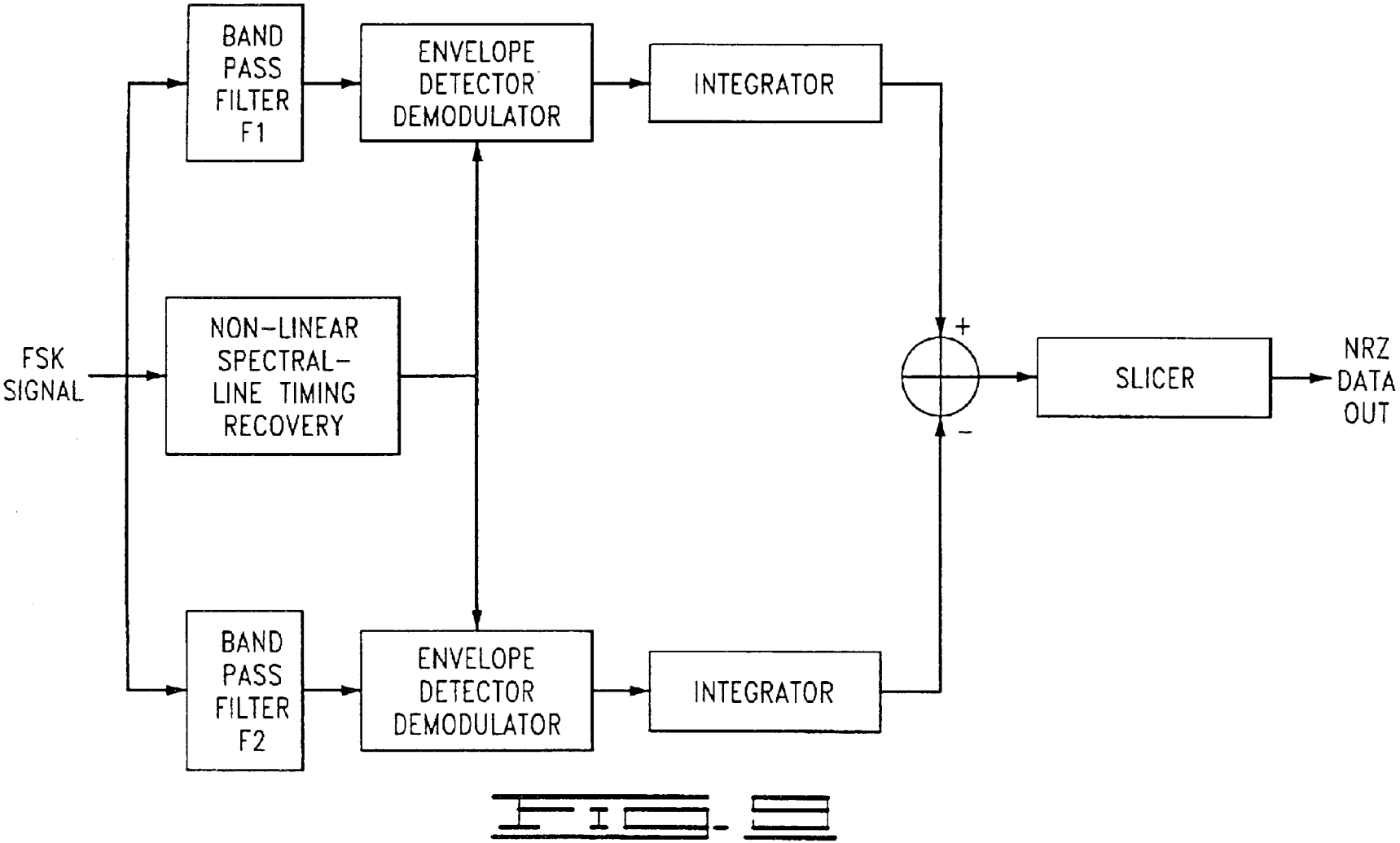

A block diagram of a FSK/OOK telemetry system in accordance with the present invention is shown in FIG. 8. A data source 100 includes a suitable measurement device, such as a pressure transducer. A transmitter 102 may use either FSK or OOK encoding. FSK signals are well known in digital communication. An FSK signal includes a tone burst at one frequency for a logic "1" and a tone burst at another frequency for a logic "0". An OOK signal includes a tone burst for a logic "1" and no transmission during the interval of a logic "0". In FIG. 8 an acoustic transducer 104, such as a piezoelectric stack, drives the acoustic telemetry signal into coiled tubing transmission medium 106. The coiled tubing transmission medium 106 of this example is the coiled tubing in which the acoustic signal is carried. An acoustic terminator 108 (again, such as the stripper packer 8) at the receiver end of the coiled tubing transmission medium 106 of the FIG. 8 implementation is a mechanical device that absorbs the acoustic telemetry signal so that it does not reflect back downhole. An accelerometer 110 receives the signal through the acoustic terminator 108 and provides it to a FSK/OOK receiver 112 that may be either an FSK receiver or an OOK receiver known in the art. A computer 114, of any suitable type such as suitably programmed microcontrollers or personal computers for use at oil or gas wells, receives the output from the FSK/OOK receiver 112. Multiple channels of FSK and OOK signals can be created by using multiple carrier frequencies. A different signal (FSK or OOK) is generated for each channel and then frequency shifted to the appropriate channel by mixing the signal with the appropriate carrier frequency.

Implementations of the transmitter 102 and receiver 112 can be the same as in the known Halliburton ATS system. FIG. 9 illustrates an implementation similar to an ATS receiver, for example. This receiver first filters the received FSK signal into two complementary OOK signals each centered at one of the two FSK tone frequencies. The separate OOK signals are then demodulated to recover the two OOK baseband signals. These two separate complementary OOK signals are then separately integrated over the bit periods. Subtracting the two signals then recombines the separate integrated OOK signals. The recombined integrated signal is then level sliced to recover an NRZ signal from which the originally transmitted data is easily recovered. An OOK telemetry system can be implemented with the foregoing by using one frequency instead of two as in FSK.

In telemetry tests, data were recovered at rates ranging from 20 to 160 bits per second (bps) from FSK and OOK signals. Tests were conducted on 2⅜" and 2⅞" coiled tubing. The coiled tubing was tested open in air and enclosed in 7" casing. Coiled tubing was tested with multiple fluids. Results showed that there was attenuation of about 5 decibels (dB) per 1000 feet in air, 12–17 dB when in casing with the stripper packer closed, and an additional 1–2 dB per 1000 feet with water, 2% potassium chloride, or 2% potassium chloride and gel. The frequency response was broad under all conditions. Transmission speeds of at least 20 bits per second were obtained in all cases, with a maximum of 160 bits per second using existing ATS based schemes. Telemetry rates greater than 100 bits per second are expected, depending on the signal-to-noise ratio.

Figure 10:
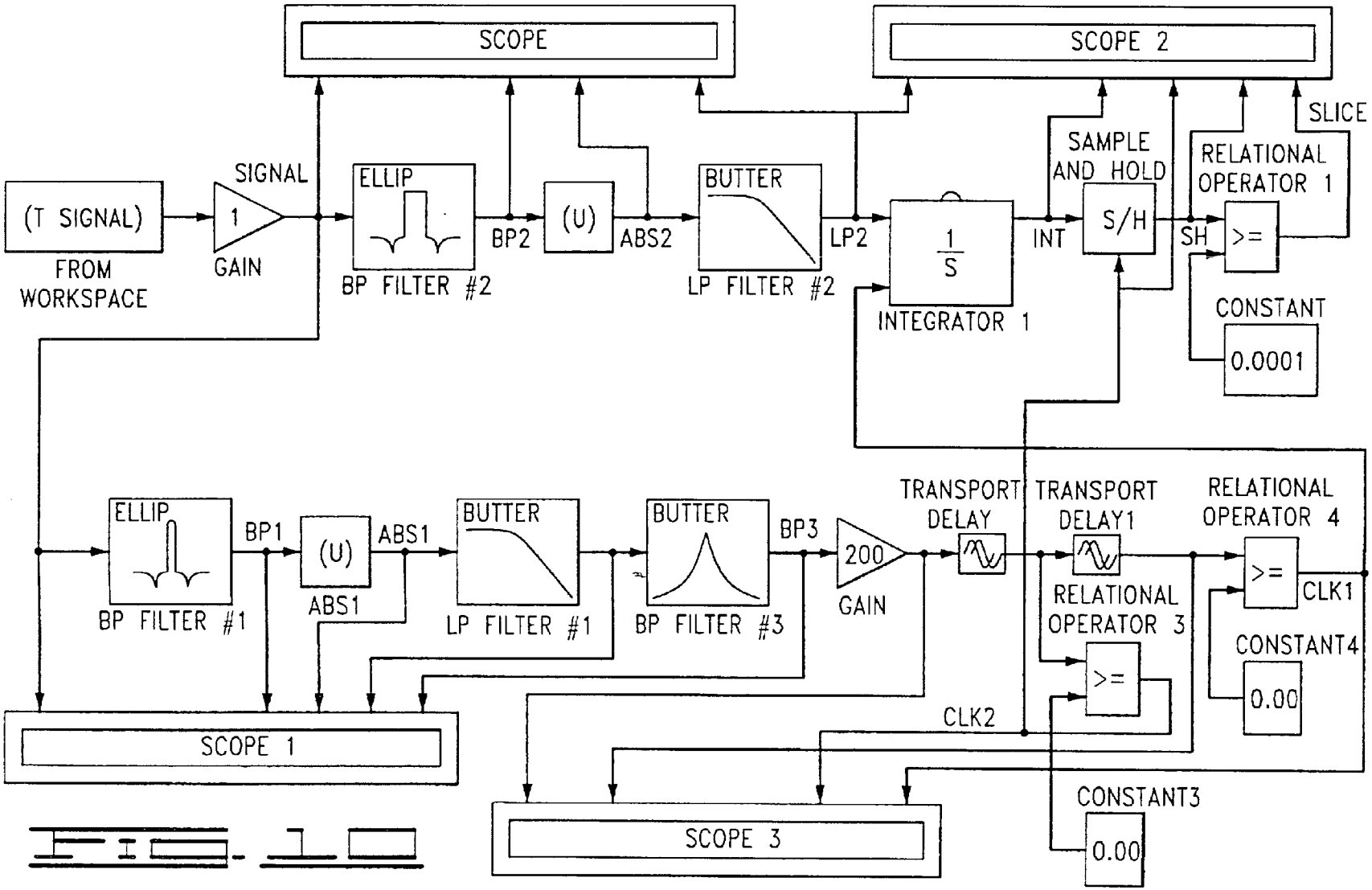
FIG. 10 represents a MATLAB simulator model for an OOK receiver.

One specific example is represented in FIGS. 10–18, which show MATLAB simulator derived information regarding the recovery of data from 160 bps OOK acoustic telemetry signals transmitted through 1000 feet of coiled tubing inside casing with a gel and 2% KCl solution. FIG. 10 is the MATLAB simulator model for an OOK receiver. The input telemetry signal is passed through a bandpass filter centered at the carrier tone frequency to remove out-of-band noise (BP FILTER #2–8$^{th}$ order bandpass elliptic 785 to 1585 hertz, 2 dB passband ripple, 40 dB sideband attenuation). The OOK signal is then demodulated with an absolute value circuit (ABS2) and a low pass filter (LP FILTER #2–3$^{rd}$ order low pass elliptic 800 radians per second). The OOK signal is then integrated over the bit period (INTEGRATOR 1) and detected with a bit slicer (RELATIONAL OPERATOR). A data clock determines the integration start and stop times. The data clock is generated by passing the OOK signal sequentially through a bandpass prefilter (BP FILTER #1–8$^{th}$ order bandpass elliptic 985 to 1385 hertz, 2 dB passband ripple, 40 dB sideband attenuation), a nonlinear device (ABS1), a low pass filter (LP FILTER #1–3$^{rd}$ order low pass elliptic 800 radians per second), a narrow band clock rate filter (BP FILTER #3–7$^{th}$ order bandpass 82 to 86 hertz) and a clock regeneration circuit (TRANSPORT DELAYS and RELATIONAL OPERATOR 4).

FIGS. 11 through 19 represent signals present at various points in the OOK receiver shown in FIG. 10.

Figure 11:
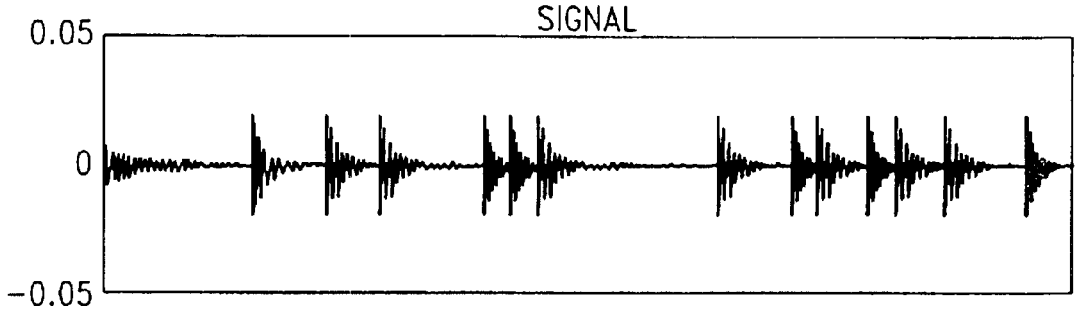
FIG. 11 shows a telemetry signal into the receiver of the FIG. 10.

FIG. 11 shows the OOK acoustic telemetry signal received through 1000 feet of coiled tubing as transduced into an electric signal provided into the OOK receiver.

Figure 12:
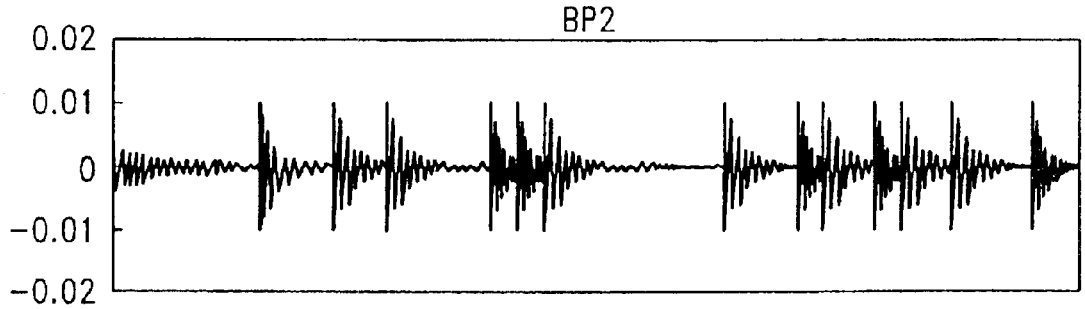
FIG. 12 shows an OOK signal after it has been bandpass filtered by the FIG. 10 receiver.

FIG. 12 shows the OOK signal after it has been bandpass filtered to remove noise. In this case there is little noise.

Figure 13:
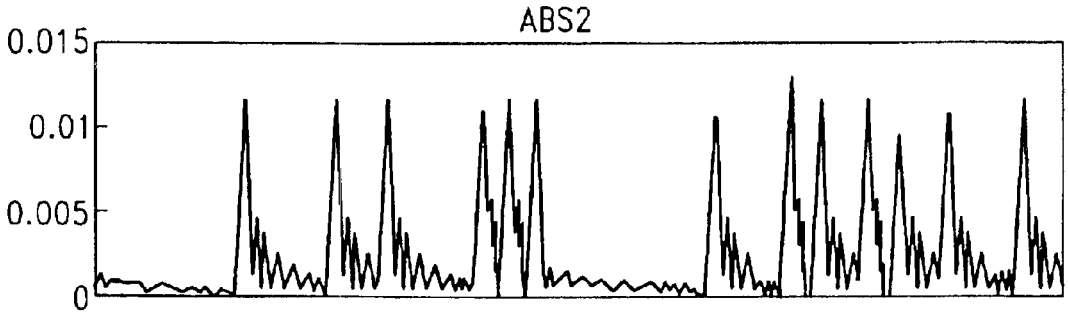
FIG. 13 shows a rectified OOK signal out of an absolute value circuit of the FIG. 10 receiver.

FIG. 13 shows the rectified OOK signal out of an absolute value circuit (ABS2 of FIG. 10).

Figure 14:
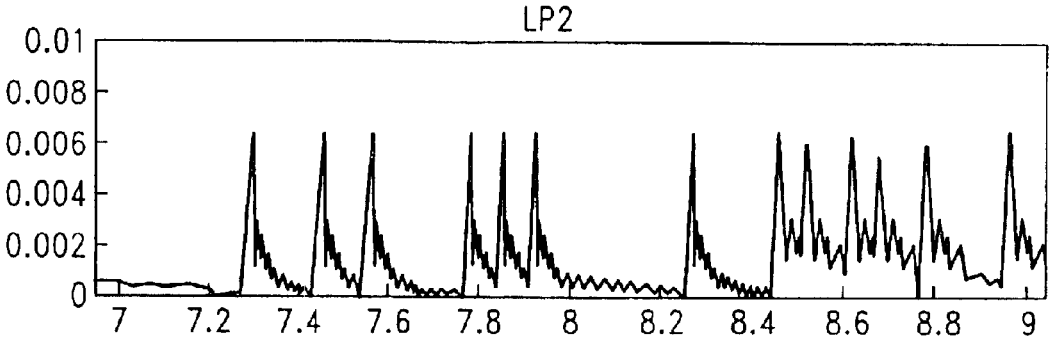
FIG. 14 shows a demodulated OOK signal out of a low pass filter of the FIG. 10 receiver.

FIG. 14 shows the demodulated OOK signal out of a low pass filter (LP FILTER #2 of FIG. 10).

Figure 15:
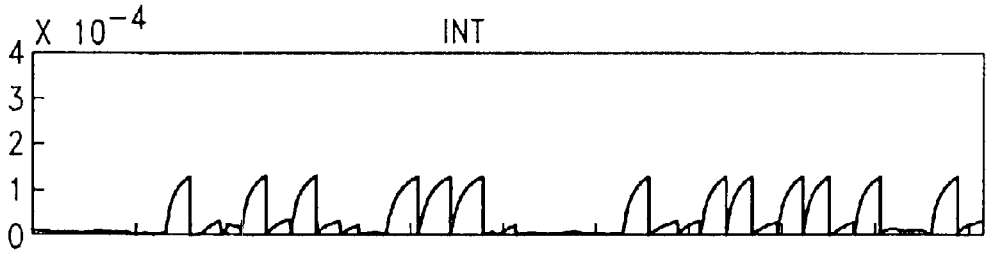
FIG. 15 is an integrated telemetry signal of the FIG. 10 receiver.

FIG. 15 is the integrated telemetry signal (INTEGRATOR 1 output of FIG. 10).

Figure 16:
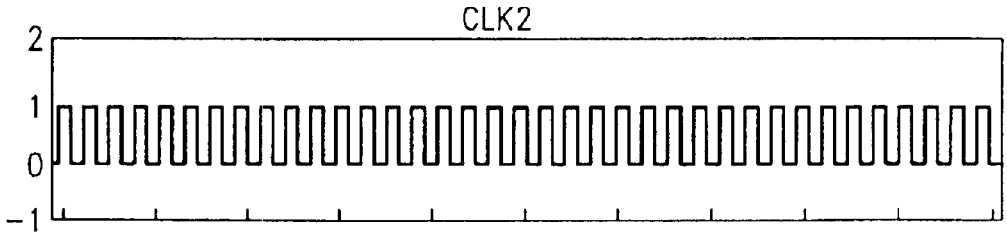
FIG. 16 is a data clock signal that determines start and stop times of an integrator in the FIG. 10 receiver.

FIG. 16 is the data clock signal that determines the start and stop times of the integrator (RELATIONAL OPERATOR #4 output of FIG. 10).

Figure 17:
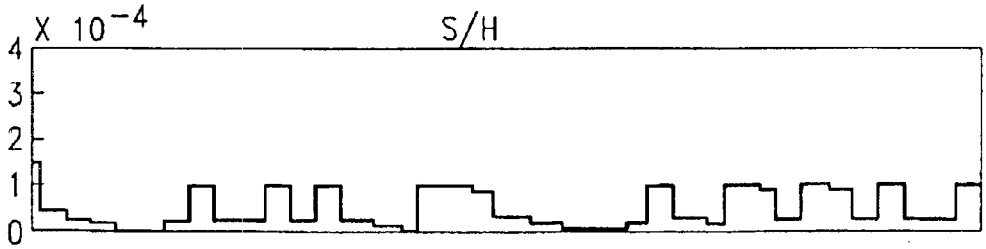
FIG. 17 is a "held" output from the integrator of the FIG. 10 receiver.

FIG. 17 is the "held" output from the integrator (SAMPLE AND HOLD output of FIG. 10).

Figure 18:
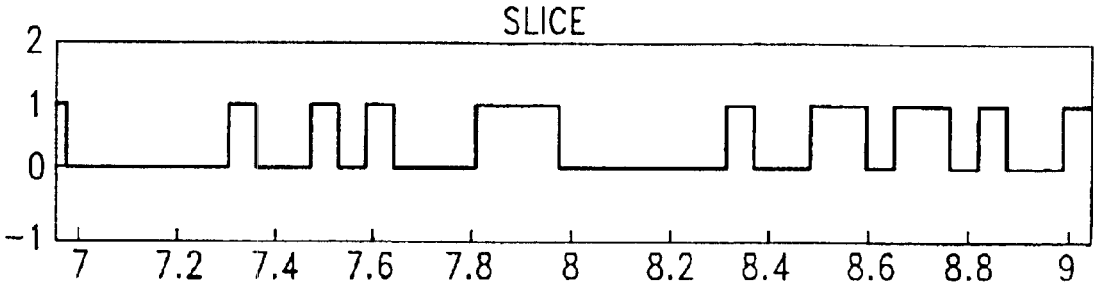
FIG. 18 shows a detected NRZ data signal out after the integrator output has been "sliced" in the FIG. 10 receiver.

FIG. 18 shows the detected NRZ data signal out after the integrator output has been "sliced" (RELATIONAL OPERATOR #1 output of FIG. 10).

The foregoing example shows successful communication of digital data encoded in an acoustic signal along 1,000 feet of coiled tubing. That is, a modulated acoustic signal was transmitted from one end along a 1000-foot coiled tubing, received at the other end, and processed using the MATLAB simulator model for an OOK receiver of FIG. 10 to obtain a digital transmission rate of 160 bps. In view of the passband up to at least 2 kilohertz shown in FIG. 5A, it is contemplated that very high digital transmission fates in excess of 100 bps (such as up to 2 kilobits per second) can be obtained.

One specific application of this invention is for COBRA FRAC fracturing service application of coiled tubing. Other "smart" coiled tubing applications may include, coiled tubing treatment services, reservoir conformance services, coiled tubing based drilling and testing services.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. An acoustic communication device for coiled tubing, the acoustic communication device comprising:

wellhead equipment for moving the coiled tubing into a well;

an acoustic member; and a traveling member connected to the acoustic member;

wherein the traveling member is configured to respond to the wellhead equipment that moves the coiled tubing into the well such that the traveling member moves the acoustic member relative to the coiled tubing in response to operation of the wellhead equipment relative to the coiled tubing.

2. The acoustic communication device as defined in claim 1, wherein the wellhead equipment comprises a stripper packer, and the traveling member is responsive to operation of the stripper packer.

3. The acoustic communication device as defined in claim 2, wherein the stripper packer is hydraulically actuated and the traveling member is hydraulically actuated concurrently with hydraulic actuation of the stripper packer.

4. The acoustic communication device as defined in claim 3, wherein the acoustic member comprises an accelerometer.

5. An acoustic communication device for a coiled tubing system including a stripper packer having a hydraulic actuator, the acoustic communication device comprising an accelerometer adapted to move selectably between contact and non-contact positions relative to coiled tubing moved into a well through the stripper packer, wherein movement of the accelerometer relative to the coiled tubing is responsive to the hydraulic actuator operating the stripper packer.

6. The acoustic communication device as defined in claim 5, further comprising a hydraulic piston hydraulically connected to the hydraulic actuator, wherein the accelerometer is connected to the hydraulic piston.

7. The acoustic communication device as defined in claim 6, further comprising a mounting block connected to the accelerometer and the hydraulic piston, wherein the mounting block includes a surface, disposed between the accelerometer and the coiled tubing, to contact the coiled tubing when the accelerometer is in the contact position.

8. A system for acoustic communication along coiled tubing operatively associated with a wellhead assembly, the system comprising:

a stripper packer through which the coiled tubing is moved into a well, wherein the stripper packer is operable between a first state and a second state; and an acoustic communication device responsive to operation of the stripper packer between the first and second states such that when the stripper packer is in the first state, the acoustic communication device is decoupled from acoustic communication with the coiled tubing, but when the stripper packer is in the second state, the acoustic communication device is coupled for acoustic communication with the coiled tubing.

9. The system as defined in claim 8, wherein the stripper packer comprises a hydraulic actuator, and the acoustic communication device is connected to the hydraulic actuator.

10. The system as defined in claim 9, wherein the acoustic communication device comprises a hydraulic piston connected to the hydraulic actuator.

11. The system as defined in claim 10, wherein the acoustic communication device further comprises an accelerometer connected to the hydraulic piston.

12. A method of providing for acoustic communication at a wellhead, comprising the steps of:

operating a stripper packer between respective first and second positions relative to coiled tubing extending through the stripper packer; and concurrently with operating the stripper packer, moving an acoustic communication device between respective first and second positions relative to the coiled tubing.

13. The method as defined in claim 12, wherein the step of moving the acoustic communication device concurrently with operating the stripper packer comprises the step of moving the acoustic communication device in response to operating the stripper packer.

14. The method as defined in claim 13, wherein the step of operating the stripper packer comprises the step of using a hydraulic actuator of the stripper packer, and the step of moving the acoustic communication device comprises the step of operating a hydraulic piston of the acoustic communication device using the hydraulic actuator of the stripper packer.

15. The method as defined in claim 14, wherein the acoustic communication device is unclamped from the coiled tubing in the respective first position of the acoustic communication device relative to the coiled tubing, and the acoustic communication device is clamped to the coiled tubing in the respective second position of the acoustic communication device relative to the coiled tubing.

16. The method as defined in claim 12, wherein the acoustic communication device is unclamped from the coiled tubing in the respective first position of the acoustic communication device relative to the coiled tubing, and the acoustic communication device is clamped to the coiled tubing in the respective second position of the acoustic communication device relative to the coiled tubing.

17. A coiled tubing telemetry system comprising:

a downhole assembly having an acoustic transducer configured to generate modulated acoustic signals in a well;

a coiled tubing string configured to transport the acoustic signals to the surface;

a stripper packer through which the coiled tubing string is moved into the well, wherein the stripper packer is operable between a first state and a second state; and an acoustic communication device responsive to operation of the stripper packer between the first and second states such that when the stripper packer is in the first state, the acoustic communication device is decoupled from acoustic communication with the coiled tubing string, but when the stripper packer is in the second state, the acoustic communication device is coupled for acoustic communication with the coiled tubing string.

18. The coiled tubing telemetry system as defined in claim 17, wherein the modulated acoustic signals are quadrature amplitude modulated.

19. The coiled tubing telemetry system as defined in claim 17, wherein the modulated acoustic signals are discrete multi-tone modulated.

20. The coiled tubing telemetry system as defined in claim 17, wherein the modulated acoustic signals are multi-channel frequency shift key modulated.

21. The coiled tubing telemetry system as defined in claim 17, wherein the modulated acoustic signals are multi-channel on-off key modulated.

22. The coiled tubing telemetry system as defined in claim 17, further comprising a repeater spaced along the coiled tubing string to boost the acoustic signals.

* * * * *